United States Patent [19]

Troutner

[11] 4,068,442

[45] Jan. 17, 1978

[54] INTEGRAL TRUSS-SUPPORTED DECK

[75] Inventor: Arthur L. Troutner, Boise, Idaho

[73] Assignee: Trus Joist Corporation, Boise, Idaho

[21] Appl. No.: 664,494

[22] Filed: Mar. 8, 1976

[51] Int. Cl.[2] ..... E04C 3/02; E04B 5/52

[52] U.S. Cl. ..... 52/693; 52/480; 52/646; 52/655

[58] Field of Search ..... 52/480, 693, 648, 646, 52/655, 650

[56] References Cited

U.S. PATENT DOCUMENTS

| | | | |
|---|---|---|---|
| 3,314,209 | 4/1967 | Troutner | 52/693 |
| 3,330,087 | 7/1967 | Troutner | 52/693 |
| 3,336,706 | 8/1967 | Troutner | 52/693 |
| 3,422,591 | 1/1969 | Troutner | 52/693 |
| 3,466,824 | 9/1969 | Troutner | 52/648 |
| 3,744,206 | 7/1973 | Nelson | 52/646 |
| 3,946,532 | 3/1976 | Gilb | 52/693 |

FOREIGN PATENT DOCUMENTS

| | | | |
|---|---|---|---|
| 282,965 | 5/1952 | Switzerland | 52/655 |

*Primary Examiner*—Price C. Faw, Jr.
*Assistant Examiner*—Robert C. Farber
*Attorney, Agent, or Firm*—Eugene D. Farley

[57] ABSTRACT

An integral, truss-supported deck suitable for massive applications such as stadia and bridges having clear spans of several hundred feet comprises outer and inner spaced chords each comprising at least one pair of substantially coplanar planks; a plurality of truss web members arranged zig-zag between the chords; a plurality of side connectors positioned in longitudinally spaced relation along the adjacent side edges of each plank pair, first fasteners fastening the ends of adjacent web members to the adjacent side connectors, thereby connecting the web members to the planks; and second fasteners fastening the side connectors to the adjacent planks, thereby connecting the planks to each other.

4 Claims, 14 Drawing Figures

FIG. 3
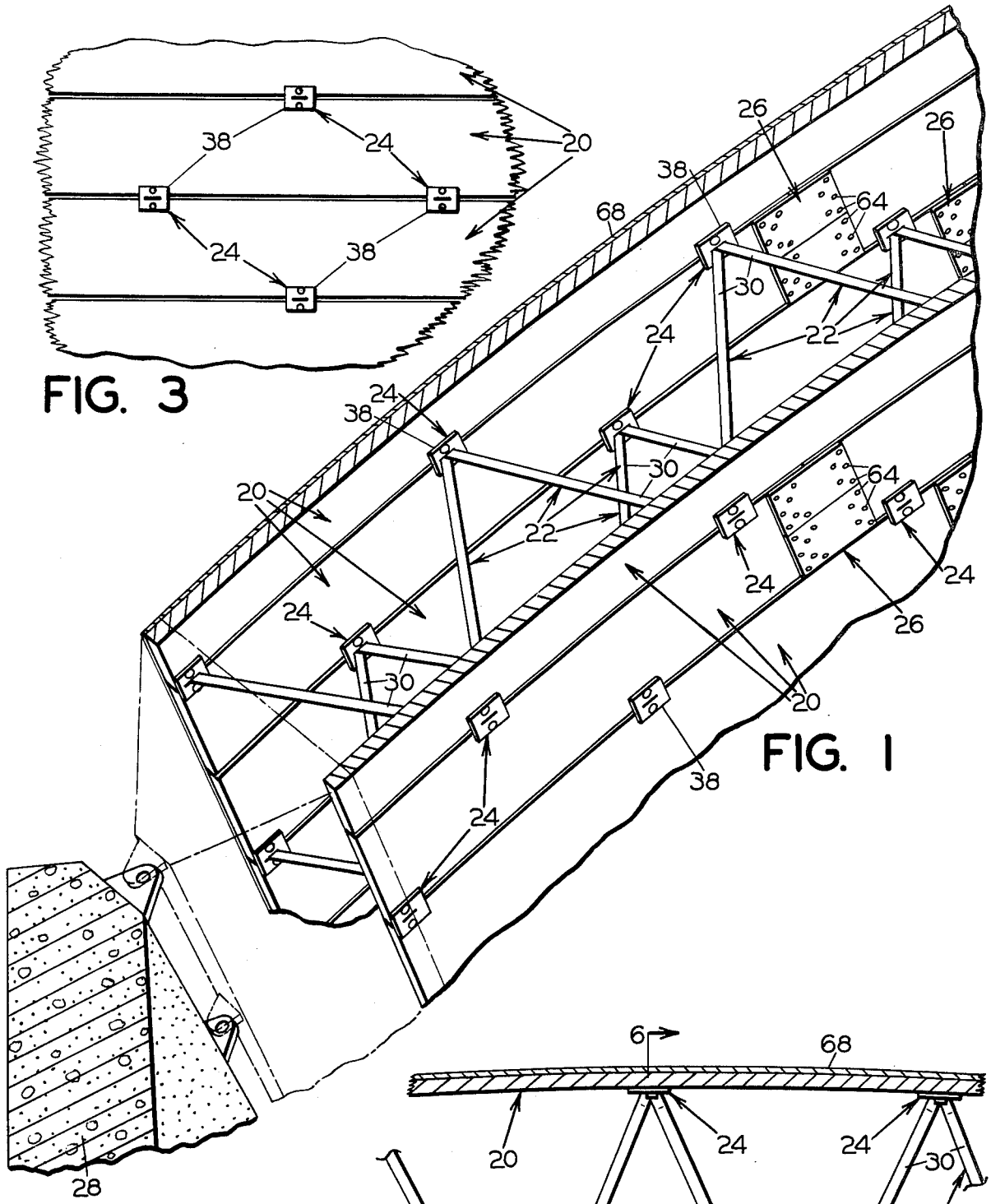
FIG. 1
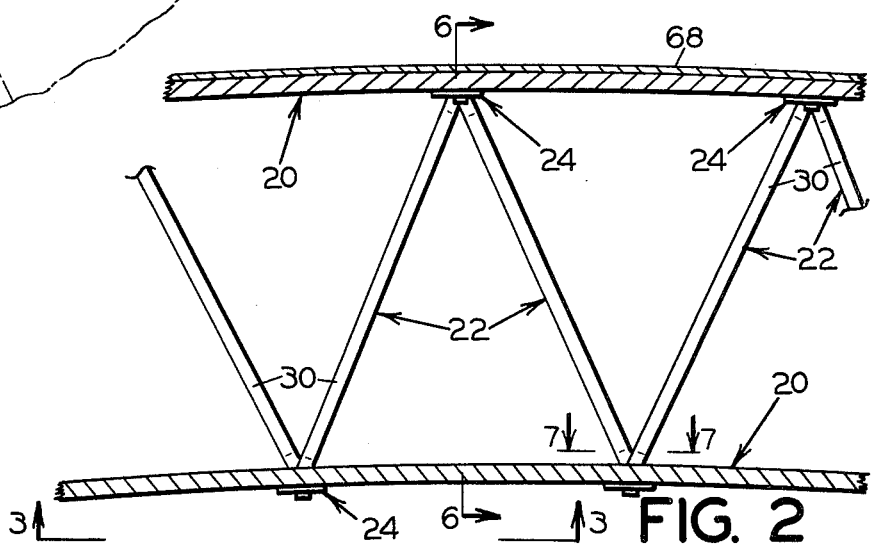
FIG. 2

INTEGRAL TRUSS-SUPPORTED DECK

BACKGROUND AND BRIEF STATEMENT OF THE INVENTION

This invention relates to structural deck assemblies. It pertains particularly to an integral, truss-supported deck useful in the construction of massive structures such as stadia domes and bridge decks having clear spans of several hundred feet.

Troutner U.S. Pat. No. 3,019,491 discloses a composite truss-supported deck wherein the deck panels are used as the chords of a truss.

Troutner U.S. Pat. No. 3,723,230 discloses a continuous press for pressing glue-coated consolidatable press charges, in particular glue coated wood veneers, into massive laminated planks or billets measuring, for example, 80 feet long, 2 feet wide and 2 inches thick.

It is the principal purpose of the present invention to provide an integral truss-supported clear span deck of great length and of the general class set forth in Troutner U.S. Pat. No. 3,019,491 aforesaid, but making use of the massive planks produced by the continuous press of Troutner U.S. Pat. No. 3,723,230 which has made available such structural components for the first time at competitive cost on a practical production basis.

It is a further object of the present invention to provide an integral truss-supported deck assembly which is applicable in the construction of a variety of wide span building structures including especially stadia domes and bridges.

Still another object of the present invention is the provision of an integral truss-supported deck which may be made from wood as a primary component, which is easily and quickly assembled on the construction site, which is relatively light in weight, and which is of great strength.

Still a further important purpose of the present invention is the provision of an integral truss-supported deck which, even though it is of great length, can be constructed with a high degree of accuracy, for example to a tolerance of 1/32nd inch in a span of 400 feet.

Still a further object of the present invention is the provision of an integral, truss-supported deck which is not affected adversely by changes in atmospheric conditons, in particular by changes of temperature and humidity, even though it is a composite of wood and metal components.

The foregoing and other objects of this invention are achieved by the provision of a deck assembly which, broadly stated, comprises outer and inner spaced chords each including pairs of substantially coplanar planks arranged with their side edges adjacent and preferably spaced from each other. A plurality of truss web members is arranged zig-zag between the chords.

A plurality of side connectors is positioned in longitudinally spaced relation along the adjacent side edges of each plank pair. Each side connector comprises a body which is inserted in the space between the planks. On each side of the body there is a laterally extending projection configured to engage the adjacent plank.

First fasteners fasten the ends of adjacent web members to the adjacent side connectors, thereby connecting the web members to the planks. Second fasteners fasten the lateral projections on each side connector to the adjacent planks, thereby connecting the planks to each other. Where long spans are contemplated, the plank pairs are placed in end-to-end abutting relation and the abutted ends are tied to each other by means of plates lapping the joints and secured to the planks.

The resulting deck may be made flat where the chords are straight, or cambered into any desired arch form when the chords are disposed in arches.

DESCRIPTION OF PREFERRED EMBODIMENTS OF THE INVENTION

The integral, truss-supported deck of the invention is described herein with particular reference to the drawings wherein:

FIG. 1 is a fragmentary bottom perspective view of the hereindescribed truss-supported deck in a first embodiment.

FIGS. 2 and 3 are fragmentary views in section and bottom plan, respectively, further illustrating the deck of FIG. 1.

Figure 14:
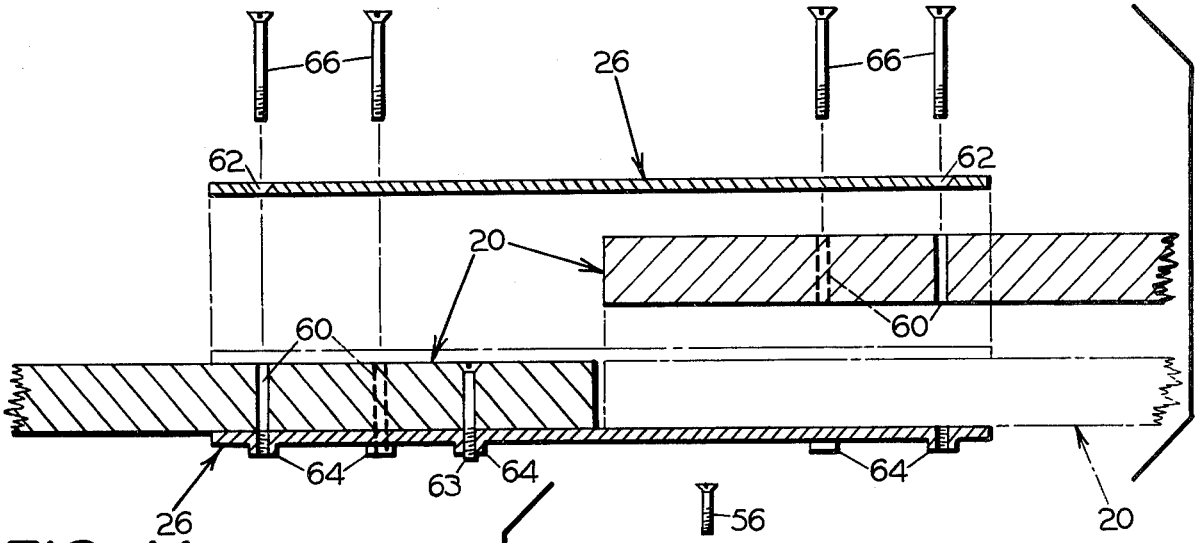
FIG. 14 is a fragmentary sectional, exploded view illustrating the manner of assembly of the component units end-to-end in the fabrication of the completed deck assembly.
Figure 13:
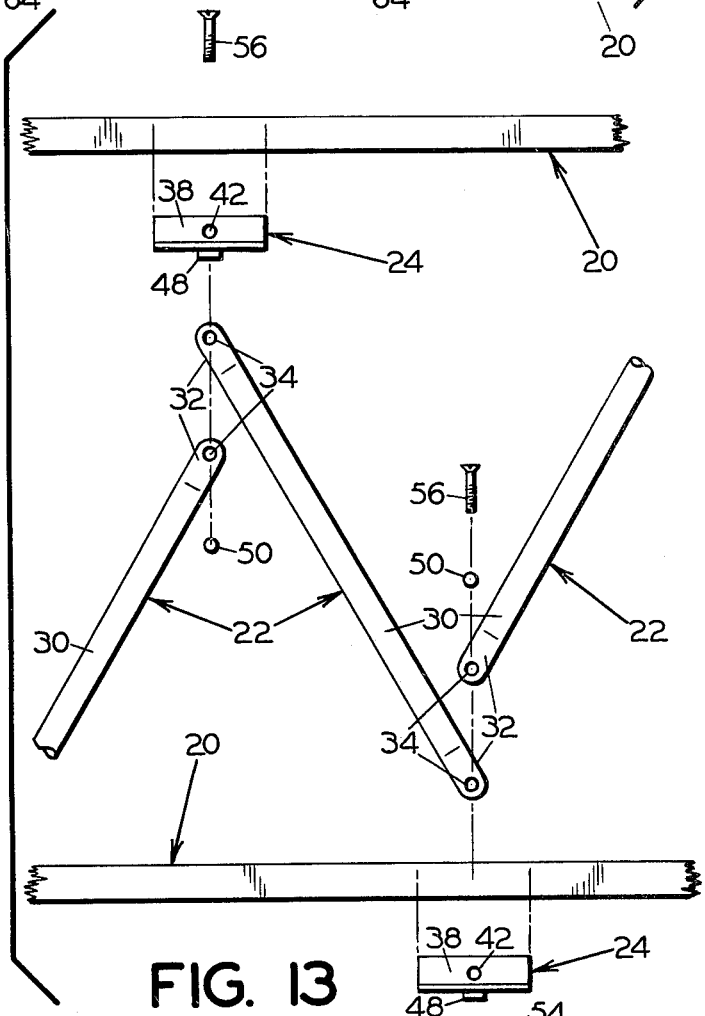
FIG. 13 is a fragmentary exploded view illustrating the manner of assembling of the components of the hereindescribed deck into structural units.

Considering first the embodiment of FIGS. 1–8 inclusive:

The integral truss-supported deck assembly of the invention basically consists of a plurality of wood planks ("billets") 20, which form the chords of the truss; a plurality of truss web members or links indicated generally at 22 and in aggregate forming the truss web interconnecting the chords; a plurality of side connectors ("clips") indicated generally at 24 and used for connecting the chords in side-by side relationship to each other; a plurality of end connectors indicated generally at 26 and used for connecting the chords end-to-end; and terminal hardware, not illustrated, used for attaching the ends of the chords to a bearing wall 28 in the construction of a building including the hereindescribed deck.

As noted above, planks or billets 20 comprise massive elements which may measure, for example, 80 feet in length, 2 feet in width and about 2 inches in thickness. It is contemplated that these are to be made of wood, although metal or plastic planks conceivably could be employed. When made of wood, they may comprise sawn boards. Preferably, however, they comprise continuous laminated planks made by gluing together plywood sheets face-to-face in a continuous press such as that described in Troutner U.S. Pat. No. 3,723,230. Such planks are of great strength, have uniform and reproducible properties along their length, are competitive in cost, and hence are ideally suited for the present purposes.

Web members 22 preferably comprise lengths of steel pipe 30 having flat ends 32 with transverse perforations 34. Such web members are well known in the truss art, are easily fabricated from steel pipe, and have great strength. Accordingly, they are well suited for use with massive planks 20 in the fabrication of the deck.

Planks 20 and web members 22 are assembled into the completed deck by placing the planks side-by-side in outer and inner chord arrangement with the chords being interconnected by a zig-zag lacing of web member 22. In the normal application of the deck, the outer chords comprise the top chords and the inner chords comprise the bottom chords. Together with the web members 22, they may be assembled in any desired configuration, flat, arched, domed, or angular. Where a deck having a long, clear span such as a stadium covering is contemplated, the assembly is fabricated in a domed contour.

Although the planks may be placed in side abutting relationship, or even interconnected by tonque and groove joints with suitable connector-receiving recesses being provided, it is preferred to arrange them with their side edges adjacent but spaced from each other by a distance predetermined to receive the connectors, thereby burying the latter within the body of the deck.

Figure 5:
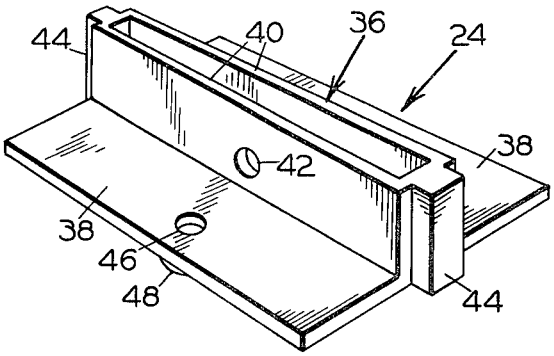
FIG. 5 is a top perspective view of a side connector employed to fasten the planks in side-by-side relation and to connect the truss web members thereto in the fabrication of the deck.
Figure 8:
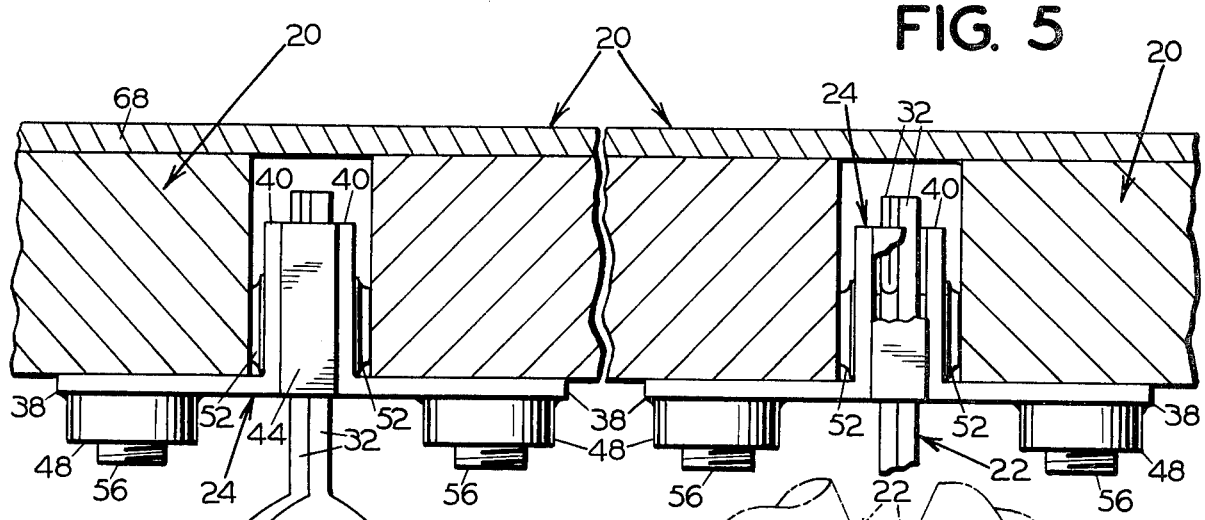
FIG. 8 is a fragmentary, detailed, sectional view taken along line 8—8 of FIG. 7.
Figure 8:
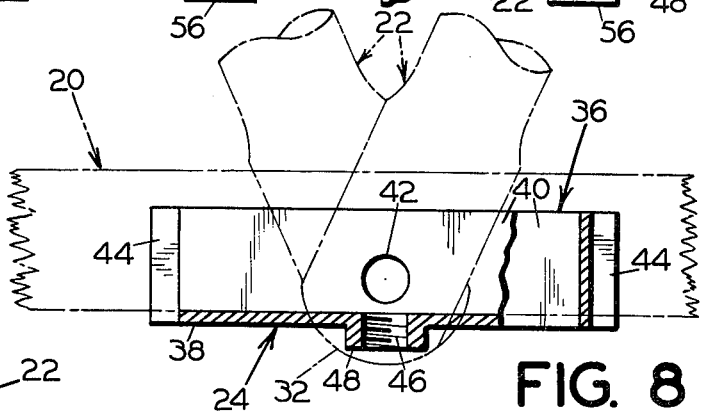

One of the side connectors 24 employed to connect the planks side-by-side in substantially coplanar, parallel arrangement is illustrated in FIG. 5. Each such connector comprises a body 36 and on each side of the body an outwardly extending, lateral projection, or flange 38.

Body 36 is dimensioned for insertion in the space present between the planks, or in recesses provided for that purpose. It normally is used in the vertical position and comprises a pair of spaced plates 40 having aligned central 42. The plates are maintained in spaced relation by end pieces 44 welded across the respective ends of the plates.

Projecting flanges 38 are designed to lap the margins of the adjacent planks. They are provided with central openings 46, which may be variously positioned to meet varying structural requirements. A nut 48 with its central opening registering with opening 46 is welded to the face of the flanges.

Side connectors 24 may be fabricated easily by welding end pieces 44 across the ends of spaced and drilled angle irons arranged back-to-back.

Side connectors 24 are located at intervals along the length of the chords. They serve the dual functions of connecting the web members 22 to the chords and of connecting the planks side-by-side to each other.

The first function is achieved by dimensioning the space between plates 36 to receive the lapped flat ends 32 of the web members with the perforations 34 therethrough aligned with openings 42 in the plates. First fastening means then is employed for fastening together the components of this assembly.

Figure 6:
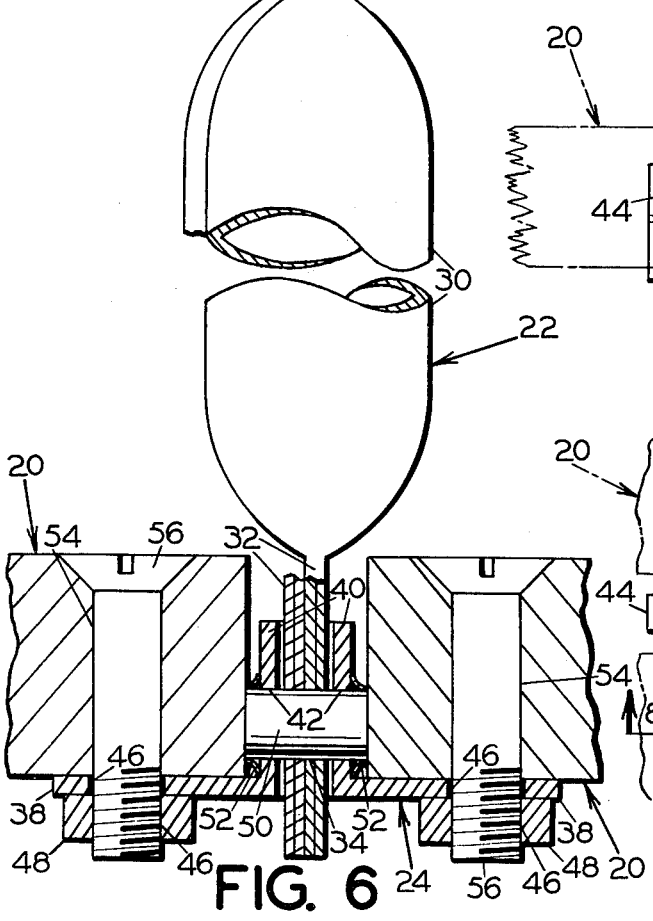
FIG. 6 is an enlarged, fragmentary, foreshortened, sectional view of the deck taken along line 6—6 of FIG. 2.
Figure 7:
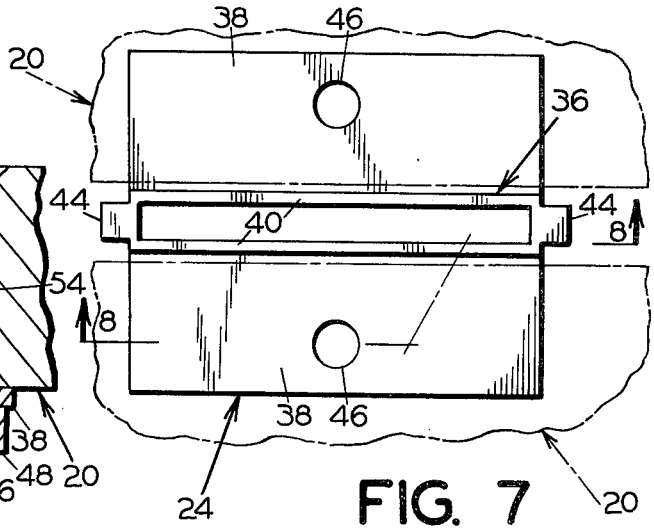
FIG. 7 is a fragmentary, detailed plan view looking in the direction of the arrows of line 7—7 of FIG. 2 and further illustrating the construction and manner of attachment of the connector of FIG. 5.
Figure 9:
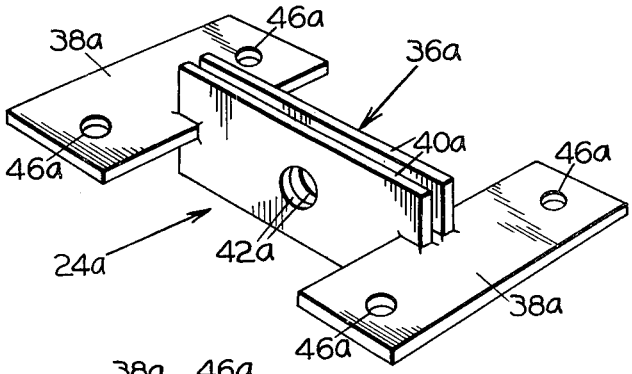
FIG. 9 is a top perspective view similar to FIG. 5 but illustrating the side connector employed in the hereindescribed deck assembly in an alternate embodiment.
Figure 10:
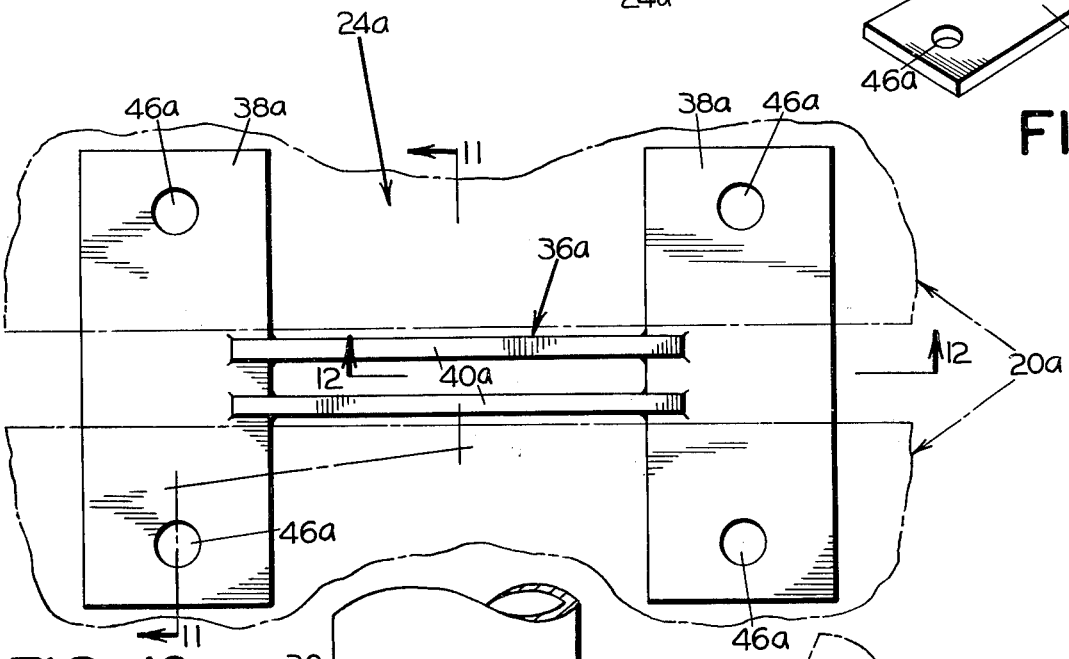
FIG. 10 is a fragmentary bottom plan view similar to FIG. 7, illustrating the application of the connector of FIG. 9.
Figure 12:
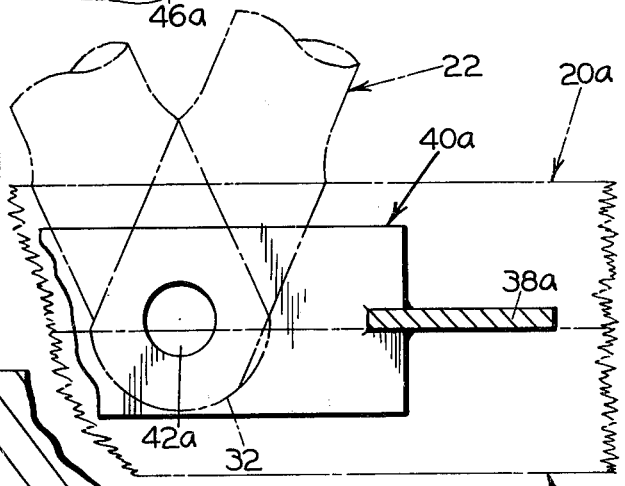
FIG. 12 is a fragmentary detailed sectional view taken along line 12—12 of FIG. 10.
Figure 11:
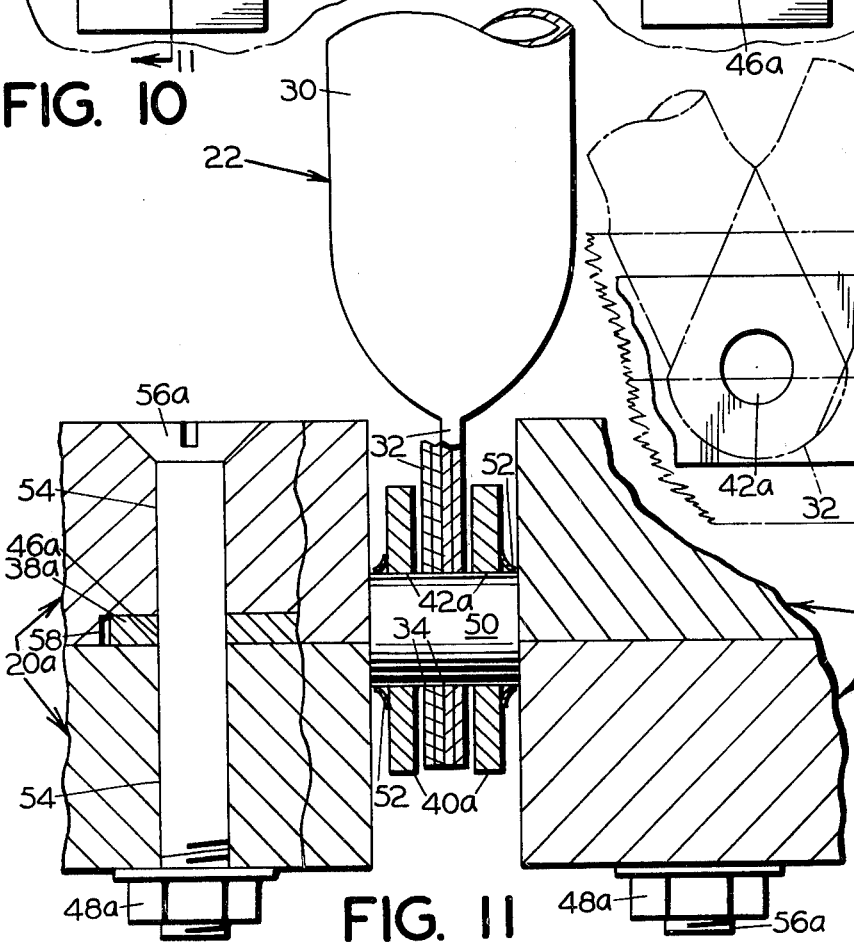
FIG. 11 is a fragmentary, detailed, transverse sectional view taken along line 11—11 of FIG. 10.

In the illustrated form of the invention the fastening means comprises a pin 50 having a length sufficient to extend entirely through the assembly and project outwardly therefrom on each side, FIG. 6. Press-on friction type washers 52 then are pressed over the ends of the pin until they bear against the outer faces of connector body plates 40. In the alternative, the ends of the pin may be riveted or swaged to provide the desired connection.

The web members accordingly are connected to the connectors, and thus to the chords, in a manner permitting adjustment relative to each other as required to construct deck assemblies having the desired camber or arch.

The second function, that of fastening the planks side-by-side to each other, is achieved by providing spaced openings 54 through the longitudinal margins of the adjacent planks. Connectors 24 are positioned with openings 46 in flanges 38 registering with the openings through the plank margins. Second fasteners in the form of bolts 56 are inserted through the registering openings and threaded into nuts 48.

The embodiment of FIGS. 9–12 inclusive is similar to that above described, with the exception that there is employed in its fabrication a unique side connector **24*a*** useful particularly in the construction of bridge decks having double planking.

Side connector **24*a* includes a body 36*a* and laterally extending projections 38*a***.

Body **36*a* is comprised of a pair of spaced plates 40*a* having central aligned perforations 42*a***.

Projections **38*a* comprise laterally extending flanges welded at substantially right angles to the ends of plates 40*a*. The flanges are provided with transverse openings 46*a***.

The opposed side edges of certain of the associated planks **20*a* are provided in the plane of the planks with central, inwardly-extending recesses 58. These are dimensioned to receive the respective ends of flanges 38*a*. Cross bores 54*a* intercept recesses 58 and are aligned with openings 46*a* through flanges 38*a*. Cross bores 54*a* receive bolts 56*a* which extend completely through the planks and through the connector flanges. The bolts are secured by means of nuts 48*a***.

Figure 4:
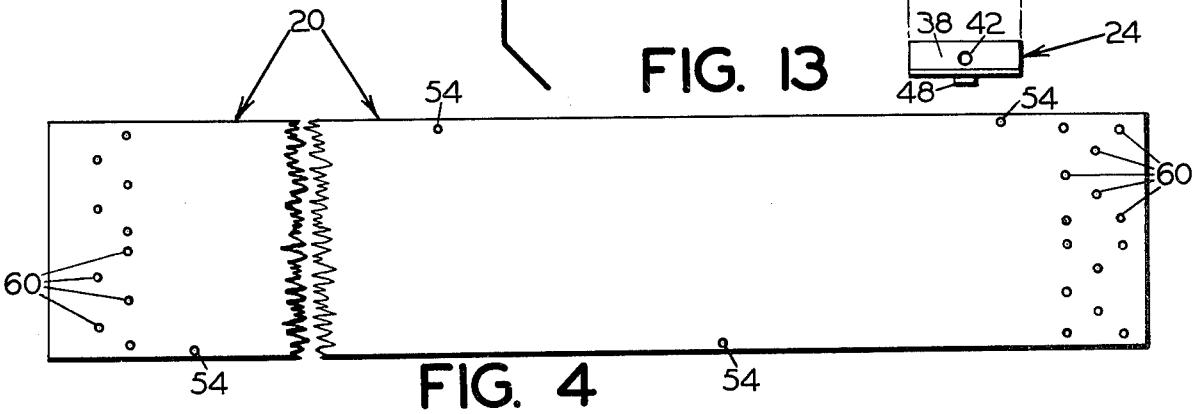
FIG. 4 is a foreshortened plan view of a plank employed in the fabrication of the deck.

The manner of assembly of the deck using connectors **36*a* is similar to that described above in connection with the assembly using connectors 36. Web members 22 are connected to the chords by means of cross pin 50 inserted through the aligned perforations 34 through the lapped web member ends, and openings 42*a* through the connector body. The planks are connected side-by-side by inserting flanges 38*a* of the connectors in recesses 58 of the planks and inserting bolts 56*a* through aligned bores 54*a* and flange openings 46*a***.

Where decks having long clear spans are contemplated, the truss chords are connected end-to-end in the manner illustrated in FIGS. 4 and 14.

First the ends of planks 20 are drilled with a predetermined pattern of holes 60. Next there are provided plate connectors 26 drilled with a pattern of holes 62 corresponding to the pattern of holes drilled in the ends of the planks. One end of each plate is bolted with bolts 63 and nuts 64 to one of the planks in the manner illustrated in FIG. 14, with the other end of the plate projecting outwardly beyond the end of the plank. The second plank is then shifted from its full to its dashed line position, thereby placing it end-to-end with the first plank, lapping the projecting end of the connecting plate.

A second plate 26 then is superimposed on the top surface of the planks and bolted thereto with additional bolts 66 and nuts 64 entering openings 60 through the planks provided for that purpose, without removing bolts 63 previously applied.

ASSEMBLY

The manner of assembly of the hereindescribed truss-supported deck is as follows:

Given the situation where the deck is to be constructed in the form of a stadium dome having a clear span of the order of 400 feet, it will be apparent that the dome must be constructed from two or three thousand massive planks together with many thousands of steel web members and connectors. The assembly is achieved by first assembling the components into deck modules forming half arches. In each module the component planks and connectors are staggered longitudinally, to provide maximum strength and expansion control.

Each module is assembled by first assembling a group of truss webs. This is accomplished by inserting the lapped flat ends of the web members 22 into side connectors 24. The ends are held in place by inserting pins 50 and applying press-on washers 52 to the projecting ends of the pins, or in the alternative swaging the pin ends.

On an appropriate scaffolding the selected number of the resulting zig-zag arrangements of web members and connectors is coupled first to a selected number of planks 20 constituting the chords by bolting the side connectors to the planks using bolts 56 or **56*a* as the case may be. Using splice plates 26, the completed module then is coupled end to end with other modules to form a half arch, which then is hoisted to the support wall 28 and its end connected with pin hinges or other suitable connectors, as illustrated schematically in FIG. 1**.

A second half arch module then is similarly mounted on an opposite wall with the ends of the two half arch modules meeting in the center of the structure. The two meeting ends are connected to each other and the sides of the module connected to a previously erected arch. This procedure is continued along the length of the stadium until the structure is completed, suitable lateral bracing or bridging rods being applied to interconnect laterally separated planks as required to prevent a racking or twisting of the completed structure.

In the completed condition of the deck, the outer chords constitute the deck surface. This surface may be covered or treated in a manner suited to its contemplated application.

Where the deck constitutes a stadium roof, its outer surface may be covered with plywood 68, FIGS. 2 and 6, nailed or stapled to the exterior surface of the upper chords. The plywood thus covers the longitudinal spaces between the planks. It then may be covered first with a layer of insulation and next with a water-proof covering nailed on or applied with a spray gun depending upon the identity of the covering materials selected.

Having thus described my invention in preferred embodiments, I claim:

1. An integral, truss-supported deck comprising:

a. outer and inner spaced chords each comprising at least one pair of substantially coplanar planks arranged with their side edges adjacent, b. a plurality of truss web members arranged zig-zag between the chords, c. a plurality of side connectors positioned in longitudinally spaced relation along the adjacent side edges of each plank pair, d. each side connector comprising a pair of back-to-back angle irons disposed with their backs in spaced relationship, said angle irons being connected to each other at their ends and thereby defining a recess between the spaced backs of said angle irons, the backs of the angle irons being provided with a pair of aligned openings, the adjacent ends of each pair of web members being flat and perforate and inserted in lapped relation into the recess with the perforations in the web member ends aligned with the openings through the angle iron backs, the laterally extending portions of the angle irons comprising lateral projections engaging the adjacent planks, e. a plurality of first fasteners comprising pin means inserted through all of said openings and perforations fastening the adjacent ends of adjacent web members to the adjacent side connectors, thereby connecting the web members to the side connectors, and f. a plurality of second fasteners fastening the lateral projections of each side connector to the adjacent planks, thereby connecting the planks to each other.

2. An integral, truss-supported deck comprising:

a. outer and inner spaced chords each comprising at least one pair of substantially coplanar planks arranged with their side edges adjacent, b. a plurality of truss web members arranged zig-zag between the chords, c. a plurality of side connectors positioned in longitudinally spaced relation along the adjacent side edges of each plank pair, d. each side connector comprising a pair of back-to-back angle irons disposed with their backs in spaced relationship, said angle irons being connected to each other at their ends and thereby defining a recess between the spaced backs of said angle irons, the backs of the angle irons being provided with a pair of aligned openings, the adjacent ends of each pair of web members being flat and perforate and inserted in lapped relation into the recess with the perforations in the web member ends aligned with openings through the angle irons backs, the laterally extending portions of the angle irons comprising lateral projections engaging the adjacent planks, e. a plurality of first fasteners comprising pin means inserted through all of said openings and perforations fastening the adjacent ends of adjacent web members to the adjacent side connectors, thereby connecting the web members to the side connectors, and f. a plurality of second fasteners comprising bolt means bolting the lateral projections of each side connector to the adjacent planks, thereby connecting the planks to each other.

3. An integral, truss-supported deck comprising:

a. outer and inner spaced chords each comprising at least one pair of substantially coplanar planks arranged with their side edges adjacent and inwardly recessed, b. a plurality of truss web members arranged zig-zag between the chords, c. a plurality of side connectors positioned in longitudinally spaced relation along the adjacent side edges of each plank pair, d. each side connector comprising a body portion comprising a pair of laterally spaced, vertically arranged, perforated plates connected to each other at their ends and thereby defining a space therebetween, and on each side of the body portion at least one projection extending laterally from each side thereof and comprising horizontally extending plates fixed one to each end of the vertical plates and dimensioned to enter the recesses at the side edges of the planks, e. a plurality of first fasteners fastening the adjacent ends of adjacent web members to the adjacent pair of vertical plates, thereby connecting the web members to the side connectors, and f. a plurality of second fasteners fastening the horizontally extending plates of each side connector to the adjacent planks, thereby connecting the planks to each other.

4. An integral, truss-supported deck comprising:

a. outer and inner spaced chords each comprising at least one pair of substantially coplanar planks arranged with their side edges adjacent and inwardly recessed, b. a plurality of truss web members arranged zig-zag between the chords, c. a plurality of side connectors positioned in longitudinally spaced relation along the adjacent side edges of each plank pair, d. each side connector comprising a body portion comprising a pair of laterally spaced, vertically arranged, perforated plates connected to each other at their ends and thereby defining a space therebetween, and on each side of the body portion at least one projection extending laterally from each side thereof and comprising horizontally extending plates fixed one to each end of the vertical plates and dimensioned to enter the recesses at the side edges of the planks, the spaced vertical plates being centrally perforated, the ends of each adjacent pair of web members being flat, perforate and dimensioned for insertion in the space between the vertical plates with the perforations in the web member ends being aligned with the perforations through the plates, e. a plurality of first fasteners comprising pin means inserted through all of the perforations fastening the adjacent ends of adjacent web members to the vertical plates, thereby connecting the web members to the side connectors, and f. a plurality of second fasteners fastening the horizontally extending plates of each side connector to the adjacent planks, thereby connecting the planks to each other.

* * * * *